US006501438B2

(12) United States Patent
Nevermann et al.

(10) Patent No.: US 6,501,438 B2
(45) Date of Patent: Dec. 31, 2002

(54) MULTIBAND HELICAL ANTENNA

(75) Inventors: Peter Nevermann, Kerken; Sheng-gen Pan, Kamp-Lintfort, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/745,542

(22) Filed: Dec. 21, 2000

(65) Prior Publication Data

US 2001/0005183 A1 Jun. 28, 2001

Related U.S. Application Data

(63) Continuation of application No. PCT/DE00/01023, filed on Apr. 3, 2000.

(30) Foreign Application Priority Data

Apr. 21, 1999 (DE) ..... 199 18 060

(51) Int. Cl.[7] ..... H01Q 1/36
(52) U.S. Cl. ..... 343/895
(58) Field of Search ..... 343/702, 895; H01Q 1/36

(56) References Cited

U.S. PATENT DOCUMENTS

| | | | | |
|---|---|---|---|---|
| 5,808,586 A | | 9/1998 | Phillips et al. | 343/895 |
| 6,107,970 A | * | 8/2000 | Holshouser et al. | 343/702 |

FOREIGN PATENT DOCUMENTS

| | | | | |
|---|---|---|---|---|
| DE | 296 23 485 U1 | | 9/1998 | |
| EP | 0 777 293 A1 | | 6/1997 | |
| EP | 0 855 759 A2 | | 7/1998 | |
| JP | 58-137206 | * | 8/1983 | 336/200 |
| WO | WO 99/14819 | | 3/1999 | |

* cited by examiner

*Primary Examiner*—Michael C. Wimer
(74) *Attorney, Agent, or Firm*—Laurence A. Greenberg; Werner H. Stemer; Ralph E. Locher

(57) ABSTRACT

An antenna includes first and second convex-curved antenna elements, which are connected in series via webs extending in a longitudinal direction of the antenna, such that they form a helical configuration. A further antenna element may extend parallel to the helical configuration. The antenna can be stamped from a single metal part, can be bent into a desired shape, and is particularly suitable for multiband applications.

17 Claims, 1 Drawing Sheet

MULTIBAND HELICAL ANTENNA

CROSS-REFERENCE TO RELATED APPLICATION

This application is a continuation of copending International Application No. PCT/DE00/01023, filed Apr. 3, 2000, which designated the United States.

BACKGROUND OF THE INVENTION

Field of the Invention

The invention relates to an antenna, in particular a helical antenna, and to a method for producing such an antenna.

In mobile radiocommunication devices, the form, that is to say the external appearance, plays a major role in the configuration of antennas. Furthermore, modern mobile radiocommunication devices should be usable not only in one mobile radiocommumication network, that is to say in one frequency band, but in a number of frequency bands.

So-called multiband antennas are therefore required, which can be used in two or more frequency bands. In this case the requirements with respect to performance and the appearance or shape of the antenna should be achievable in a simple and cost-effective manner.

Currently, multiband antenna systems are used which include a number of individual antennas, for example cylindrically symmetrical helical wire structures or planar antennas, for example so-called printed circuit boards (PCBs). To improve the appearance or form, it is possible to fit these conventional solutions in a housing which does not correspond to the basic shape of the antenna, that is to say, for example, an antenna housing having an elliptical cross section can be chosen instead of a cylindrically symmetrical cross section. However, a relatively large amount of space is then required for the entire antenna system, so that the requirement with respect to appearance, form and minimum possible equipment dimensions is not satisfied, or the desired appearance, form or shape cannot be implemented.

SUMMARY OF INVENTION

It is accordingly an object of the invention to provide an antenna configuration which overcomes the above-mentioned disadvantages of the heretofore-known antenna configurations of this general type and which, firstly, can be produced in a simple and cost-effective manner and, secondly, allows to freely shape the external appearance or form of the antenna. In particular, the antenna configuration should allow a simple way of upgrading or expansion to a multiband antenna. It is a further object of the invention to provide a method of producing such an antenna.

With the foregoing and other objects in view there is provided, in accordance with the invention, an antenna configuration, including:

an antenna having first convex-curved antenna elements, second convex-curved antenna elements, and webs;

the first convex-curved antenna elements having a first curvature, the second convex-curved antenna elements having a second curvature, the first and second convex-curved antenna elements being disposed in an alternating pattern such that the first curvature and the second curvature are curved in opposite directions;

the first and second convex-curved antenna elements having respective adjacent ends; and the antenna defining a longitudinal direction, the webs extending in the longitudinal direction and connecting the respective adjacent ends of the first and second convex-curved antenna elements such that the first and second convex-curved antenna elements are connected in series without overlapping one another in the longitudinal direction and such that the first and second convex-curved antenna elements form a helical configuration.

In other words, the antenna according to the invention forms a helical basic structure which can be produced particularly cost-effectively simply by stamping and bending a metal or sheet-metal part. To this end, the antenna includes convexcurved and strip-shaped antenna elements, which are connected in series via webs extending in the longitudinal direction of the antenna and are provided such that they model the form of a helix. In this way, the basic structure of a helix is modified such that the antenna has only elements which —seen in the longitudinal plane of the antenna —do not overlap, so that the helix structure can be produced by a simple stamping process.

The structure of the antenna according to the invention is not necessarily cylindrically symmetrical and, furthermore, need not necessarily contain planar configurations. The curved strip antenna elements can, in fact, be shaped as desired within wide limits. Thus a high level of configurational freedom for the shape of the external appearance or form is provided. Also, a structure, which conforms to the desired appearance or shape can be formed more easily, such that, for example, the structure has a cross section which is not cylindrically symmetrical.

The standard technology of stamping and bending from metal or sheet-metal parts required to produce the antenna according to the invention allows extremely high manufacturing rates and thus low production costs. p Furthermore, the antenna contact spring, which produces the electrical contact between the antenna and the electronics of the equipment to be operated with the antenna, can be produced integrally with the actual antenna basic structure from a single stamped and bent part, which is particularly cost-effective, since the antenna contact spring can be produced together with the antenna basic structure during the same production step.

The helical basic structure of the antenna according to the invention described above can easily be upgraded to form a dual-band, triple-band, or generally multiband antenna. To do this, a further, parasitic antenna element in the form of an elongated web just has to be added to the helical basic structure with the series-connected convex-curved antenna elements. The web runs parallel to the helix and is likewise provided such that the individual elements of the antenna do not overlap at any point, viewed in the longitudinal plane of the antenna, so that this parasitic antenna element can also be manufactured together with the helical basic structure from the same stamped and bent part. The parasitic and web-like antenna element is not just connected in parallel with the helical basic structure, that is to say connected to the basic structure at the lower end, but, in particular, is provided close to this helical basic structure so as to provide a considerable level of electromagnetic coupling between the individual antenna elements and, secondly, such that the physical volume of the antenna is minimal.

This antenna construction allows to utilize the distributed inductance elements or partial inductances and capacitances of the individual antenna elements in such a way that the antenna, which thus includes a parallel circuit and a series circuit of preferably elliptically curved half-rings and straight webs, can be operated in a number of frequency bands. Furthermore, no additional matching circuit is required to set up the antenna.

According to another feature of the invention, the first and second convex-curved antenna elements are strip-shaped antenna elements; and the first and second convex-curved antenna elements are disposed parallel to one another.

According to yet another feature of the invention, the webs are straight webs.

According to another feature of the invention, the first curvature of the first antenna elements has a first radius of curvature and the second curvature of the second antenna elements has a second radius of curvature, the first radius of curvature being substantially identical to the second radius of curvature.

According to a further feature of the invention, the first and second convex-curved antenna elements are elliptically curved antenna elements.

According to another feature of the invention, the antenna includes a third antenna element extending in the longitudinal direction and essentially parallel to the helical configuration formed by the first and second convex-curved antenna elements; and the third antenna element is spaced from the helical configuration by a given distance such that the first and second convex-curved antenna elements and the third antenna element are electromagnetically coupled to one another.

According to yet another feature of the invention, the antenna has a lower longitudinal end region; and a lowermost one of the first and second antenna elements, as seen in the longitudinal direction, is connected, at the lower longitudinal end region of the antenna, to the third antenna element.

According to another feature of the invention, the third antenna element has an upper longitudinal end part; and the upper longitudinal end part has a convex curvature and extends essentially parallel to the first or second convex-curved antenna elements.

According to a further feature of the invention, an uppermost one of the first and second convex-curved antenna elements as seen in the longitudinal direction is disposed adjacent to the upper longitudinal end part of the third antenna element; and the upper longitudinal end part of the third antenna element defines a top end of the antenna.

According to another feature of the invention, the first curvature of the first convex-curved antenna elements has a first radius of curvature; the second curvature of the second convex-curved antenna elements has a second radius of curvature; the convex curvature of the upper longitudinal end part has a third radius of curvature; and the first radius of curvature, the second radius of curvature and the third radius of curvature are substantially identical.

According to yet another feature of the invention, the webs define a given plane; and the third antenna element and the webs are disposed in the given plane.

According to another feature of the invention, the first and second convex-curved antenna elements are disposed symmetrically with respect to the given plane.

According to another feature of the invention, the antenna has a lower longitudinal end region and includes an antenna contact section at the lower longitudinal end region; and the antenna contact section is configured to be connectable to electronics of an appliance to be operated with the antenna.

According to a further feature of the invention, the webs define a given plane; the antenna includes a third antenna element extending in the longitudinal direction and essentially parallel to the helical configuration formed by the first and second convex-curved antenna elements; the third antenna element and the webs are disposed in the given plane; the antenna contact section includes a first region and a second region; the first region is connected to the lower longitudinal end region of the antenna and is bent to extend in a direction transverse to the given plane; and the second region is connected to the first region and is bent to extend transverse to the first region and substantially parallel to the given plane.

According to another feature of the invention, the antenna is a one-piece antenna.

According to yet another feature of the invention, the antenna is formed of a single metal part.

According to another feature of the invention, the antenna configuration according to the invention is used in combination with a multiband radio device.

With the objects of the invention in view there is also provided, a method for producing an antenna having antenna elements forming a helical configuration, the method includes the steps of:

stamping, from a metal part, strip-shaped antenna elements extending alongside one another and webs extending transversely with respect to the strip-shaped antenna elements, the webs connecting respective adjacent ones of the strip-shaped antenna elements at ends thereof such that the strip-shaped antenna elements are connected in series; and bending the strip-shaped antenna elements alternately upward and downward into a convex shape such that the strip-shaped antenna elements form a helical configuration.

According to another mode of the invention, a further strip-shaped antenna element is stamped from the metal part, such that a first section of the further strip-shaped antenna element extends substantially parallel to the helical configuration, and such that a second section of the further strip-shaped antenna element extends substantially parallel to at least one of the strip-shaped antenna elements, and such that a lower longitudinal end of the first section of the further strip-shaped antenna element is connected to a lower longitudinal end region of the helical configuration.

According to another mode of the invention, the second section of the further strip-shaped antenna element is bent into a convex shape.

According to another mode of the invention, an antenna contact section connected to a lower longitudinal end region of the helical configuration is stamped from the metal part, and the antenna contact section is bent such that it extends away from a given plane defined by the webs.

Other features which are considered as characteristic for the invention are set forth in the appended claims.

Although the invention is illustrated and described herein as embodied in an antenna, the use of such an antenna, and a method for producing such an antenna, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
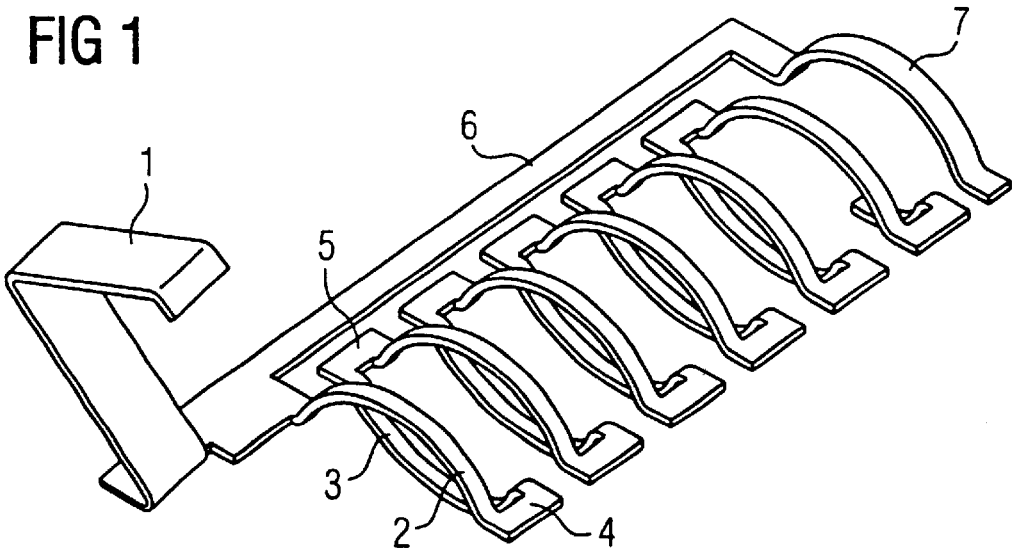
FIG. 1 is a diagrammatic perspective view of a triple-band antenna, which can be stamped out, according to a preferred exemplary embodiment of the invention.

Referring now to the figures of the drawings in detail and first, particularly, to FIG. 1 thereof, there is shown an antenna which has a helical basic structure. This helical basic structure is produced by providing convex-curved antenna elements 2, 3 with mutually matching bends or curves provided alternately in such a way that an antenna element 3 which is curved downward follows an antenna element which is curved upward, and vice versa. Those ends of two adjacent antenna elements 2, 3 which are provided adjacent to one another are connected to one another via, preferably straight, webs 4, 5 extending in the longitudinal direction of the antenna or helix, so as to form a series circuit of the individual antenna elements 2, 3, and to form the helix structure shown in FIG. 1.

The helix antenna shown in FIG. 1 can be produced easily through the use of a stamping and bending process. The strip antenna elements 2, 3, which preferably extend parallel to one another, and the adjacent ends of the webs 4, 5 connecting the antenna elements just have to be stamped out of a metal or sheet-metal part for this purpose, with the antenna elements 2 and 3 being curved alternately as shown in FIG. 1. However, the antenna elements 2, 3 may also extend obliquely with respect to one another. It can be seen from FIG. 1 that the individual elements of this helix antenna are provided in such a way that they do not overlap at any point —seen in the longitudinal direction of the antenna —which would otherwise impede the stamping process, or even make it impossible.

The radii of curvature of the individual convex-curved antenna elements 2 and 3 are preferably identical, thus resulting in a uniform helix structure. Furthermore, for configurational reasons or appearance reasons, it is advantageous to curve the antenna elements 2 and 3 elliptically. The antenna elements 2 and 3, which are in the form of half-rings, may, however, in principle be shaped in any desired manner, within certain limits, in order to produce a specific appearance, form or design.

With the antenna structure described above, an antenna contact spring 1 is preferably integrally formed at the lower longitudinal end and is used to connect the actual antenna to the electronics of the equipment to be operated by using the antenna, preferably a mobile radio. The antenna contact spring 1 can likewise easily be produced by appropriate stamping and subsequent bending of the same metal part. According to FIG. 1, the antenna contact spring 1 is formed simply by an elongated section which is then bent to a desired shape. Any desired shape may be chosen for this section, as long as the length of the section does not become too great.

It can also be seen in FIG. 1 that a further, parasitic antenna element 6 is connected in parallel with the helical basic structure described above, and is connected at the lower longitudinal end of the antenna to one end of the first antenna element 2 in the antenna longitudinal direction, and to the antenna contact spring 1. This further antenna element 6 extends, in particular, in the same plane as the connecting webs 4 and 5 and parallel to the helical basic structure of the antenna, and is likewise provided such that there are no overlaps. This further antenna element 6 can thus also be produced from the same stamped part as the rest of the antenna.

The parallel-connected antenna element 6 is provided sufficiently close to the helical basic structure with the antenna elements 2, 3 such that there is significant electromagnetic coupling between these antenna elements 2, 3 and 6 in operation and, on the other hand, such that the physical volume of the antenna can be minimized. An end section 7 is located at the upper longitudinal end of this parallel-connected antenna element 6 and preferably extends parallel to, and at the side of, the last convex-curved half-ring of the helix structure in the antenna longitudinal direction. This curved end section 7 may have the same curvature as the half-rings or antenna elements 2 which are curved upward, and is used to provide the necessary conductor strip length for an optimized electromagnetic coupling and a minimum overall antenna volume. The end section 7 terminates or bounds the antenna structure in the longitudinal direction.

The distributed partial inductances or inductance elements and capacitances of the antenna structure formed in this way and shown in FIG. 1 can thus be utilized to allow the antenna to be operated in a number of frequency bands. By appropriate optimization, the antenna can be operated close to a first resonant frequency for one of its intended frequency bands and, at the same time, can operate with a broad bandwidth close to a second resonant frequency, thus making it possible to use the antenna in two further frequency bands.

Figure 2:
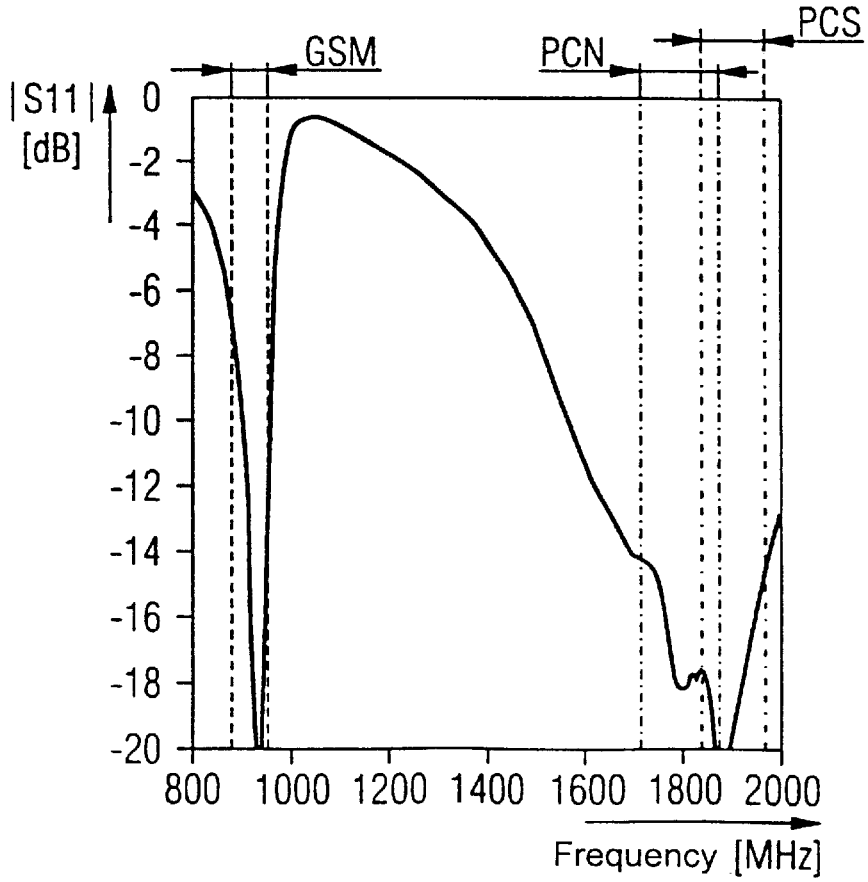
FIG. 2 is a graph illustrating the reflection factor of the antenna shown in FIG. 1, as a function of the operating frequency.

FIG. 2 shows the reflection factor $|S_{11}|$ measured for the antenna shown in FIG. 1. The illustration in FIG. 2 shows that the reflection factor assumes minimum values at a first resonant frequency in the region of the frequency band of the GSM mobile radio standard (Global System for Mobile Communication) and, in addition, at a second resonant frequency within the mutually overlapping frequency bands of the PCS (Personal Communication Services) and PCN (Personal Communication Network) mobile radio standards, so that the antenna can be operated appropriately in three different frequency bands and in accordance with three different mobile radio standards.

Furthermore, by using the antenna structure shown in FIG. 1, it is also possible to achieve a nominal impedance of about 50 ohms so that the antenna can be operated without any matching network, or just with a small number of matching elements.

We claim:

1. An antenna configuration, comprising:

an antenna having first convex-curved antenna elements, second convex-curved antenna elements, a third antenna elements and webs;

said first convex-curved antenna elements having a first curvature, said second convex-curved antenna elements having a second curvature, said first and second convex-curved antenna elements being disposed in an alternating pattern such that said first curvature and said second curvature are curved in opposite directions;

said first and second convex-curved antenna elements having respective adjacent ends;

said antenna defining a longitudinal direction, said webs extending in the longitudinal direction and connecting said respective adjacent ends of said first and second convex-curved antenna elements such that said first and second convex-curved antenna elements are connected in series without overlapping one another in the longitudinal direction and such that said first and second convex-curved antenna elements form a helical configuration; and said third antenna elements being connected to said first and second convex-curved antenna elements and extending in the longitudinal direction and essentially parallel to said helical configuration formed by said first and second convex-curved antenna elements.

2. The antenna configuration according to claim 1, wherein:

said first and second convex-curved antenna elements are strip-shaped antenna elements; and said first and second convex-curved antenna elements are disposed parallel to one another.

3. The antenna configuration according to claim 1, wherein said webs are straight webs.

4. The antenna configuration according to claim 1, wherein said first curvature has a first radius of curvature and said second curvature has a second radius of curvature, said first radius of curvature is substantially identical to said second radius of curvature.

5. The antenna configuration according to claim 1, wherein said first and second convex-curved antenna elements are elliptically curved antenna elements.

6. The antenna configuration according to claim 1, wherein:

said third antenna element is spaced from said helical configuration by a given distance such that said first and second convex-curved antenna elements and said third antenna element are electromagnetically coupled to one another.

7. The antenna configuration according to claim 6, wherein:

said antenna has a lower longitudinal end region; and a lowermost one of said first and second antenna elements, as seen in the longitudinal direction, is connected, at said lower longitudinal end region of said antenna, to said third antenna element.

8. The antenna configuration according to claim 6, wherein:

said third antenna element has an upper longitudinal end part; and said upper longitudinal end part has a convex curvature and extends essentially parallel to one of said first and second convex-curved antenna elements.

9. The antenna configuration according to claim 8, wherein:

an uppermost one of said first and second convex-curved antenna elements as seen in the longitudinal direction is disposed adjacent said upper longitudinal end part of the third antenna element; and said upper longitudinal end part of said third antenna element defines a top end of said antenna.

10. The antenna configuration according to claim 8, wherein:

said first curvature of said first convex-curved antenna elements has a first radius of curvature;

said second curvature of said second convex-curved antenna elements has a second radius of curvature;

said convex curvature of said upper longitudinal end part has a third radius of curvature; and said first radius of curvature, said second radius of curvature and said third radius of curvature are substantially identical.

11. The antenna configuration according to claim 6, wherein:

said webs define a given plane; and said third antenna element and said webs are disposed in the given plane.

12. The antenna configuration according to claim 11, wherein said first and second convex-curved antenna elements are disposed symmetrically with respect to the given plane.

13. The antenna configuration according to claim 1, wherein:

said antenna has a lower longitudinal end region and includes an antenna contact section at said lower longitudinal end region; and said antenna contact section is configured to be connectable to electronics of an appliance to be operated with said antenna.

14. The antenna configuration according to claim 13, wherein:

said webs define a given plane;

said third antenna element and said webs are disposed in the given plane;

said antenna contact section includes a first region and a second region;

said first region is connected to said lower longitudinal end region of said antenna and is bent to extend in a direction transverse to the given plane; and said second region is connected to said first region and is bent to extend transverse to said first region and substantially parallel to the given plane.

15. The antenna configuration according to claim 1, wherein said antenna is a one-piece antenna.

16. The antenna configuration according to claim 1, wherein said antenna is formed of a single metal part.

17. In combination with a multiband radio device, an antenna configuration, comprising:

an antenna having first convex-curved antenna elements, second convex-curved antenna elements, a third antenna element, and webs;

said first convex-curved antenna elements having a first curvature, said second convex-curved antenna elements having a second curvature, said first and second convex-curved antenna elements being disposed in an alternating pattern such that said first curvature and said second curvature are curved in opposite directions;

said first and second convex-curved antenna elements having respective adjacent ends;

said antenna defining a longitudinal direction, said webs extending in the longitudinal direction and connecting said respective adjacent ends of said first and second convex-curved antenna elements such that said first and second convex-curved antenna elements are connected in series without overlapping one another in the longitudinal direction and such that said first and second convex-curved antenna elements form a helical configuration; and said third antenna element being connected to said first and second convex-curved antenna elements and extending in the longitudinal direction and essentially parallel to said helical configuration formed by said first and second convex-curved antenna elements.

* * * * *